US008958149B2

(12) United States Patent
Hesse

(10) Patent No.: US 8,958,149 B2
(45) Date of Patent: Feb. 17, 2015

(54) TARGET-FIELD TELESCOPE WITH CORRECTING LENS

(75) Inventor: Helke Karen Hesse, Giessen (DE)

(73) Assignee: Schmidt & Bender GmbH & Co. KG, Biebertal (DE)

( * ) Notice: Subject to any disclaimer, the term of this patent is extended or adjusted under 35 U.S.C. 154(b) by 0 days.

(21) Appl. No.: 13/370,749

(22) Filed: Feb. 10, 2012

(65) Prior Publication Data

US 2012/0212811 A1 Aug. 23, 2012

(30) Foreign Application Priority Data

Feb. 11, 2011 (DE) ..... 10 2011 000 685

(51) Int. Cl.
*G02B 23/02* (2006.01)
*F41G 1/38* (2006.01)

(52) U.S. Cl.
CPC ..... *F41G 1/38* (2013.01)
USPC ..... 359/401; 359/399

(58) Field of Classification Search
USPC ..... 359/399, 401, 405, 422–428, 432, 359/434–435; 42/111, 119–120, 122–123, 42/130–131
See application file for complete search history.

(56) References Cited

U.S. PATENT DOCUMENTS

| | | | | |
|---|---|---|---|---|
| 3,045,545 | A | 7/1962 | Koronas et al. | |
| 4,497,548 | A | 2/1985 | Burris | |
| 5,481,405 | A * | 1/1996 | Simbal | 359/689 |
| 2009/0266892 | A1 * | 10/2009 | Windauer et al. | 235/404 |
| 2010/0238542 | A1 * | 9/2010 | Fiedler | 359/422 |

FOREIGN PATENT DOCUMENTS

| | | |
|---|---|---|
| AT | 394 457 | 4/1992 |
| DE | 20 2006 020 736 | 12/2009 |
| EP | 1 746 451 | 6/2010 |

* cited by examiner

*Primary Examiner* — William Choi
*Assistant Examiner* — Sharrief Broome
(74) *Attorney, Agent, or Firm* — Clark & Brody

(57) ABSTRACT

Regarding a sighting telescope comprising a reversing system which is configured between an objective and is fitted an ocular and fitted with an objective-proximate field lens and at least two mutually displaceable optical elements near the ocular, further comprising an objective-proximate image plane situated between the objective and the field lens and spaced from latter, further with an ocular-proximate image plane situated between the reversing system and the ocular, where, when displacing the said optical elements, an intermediate image projected by the objective into the ocular-proximate image plane is erected and reproduced at a variable magnification in the ocular proximate image plane, and at a magnification of at least 4×, the invention stipulates configuring a correcting field lens element between the objective-proximate image plane and the field lens.

13 Claims, 14 Drawing Sheets

Fig. 4a1
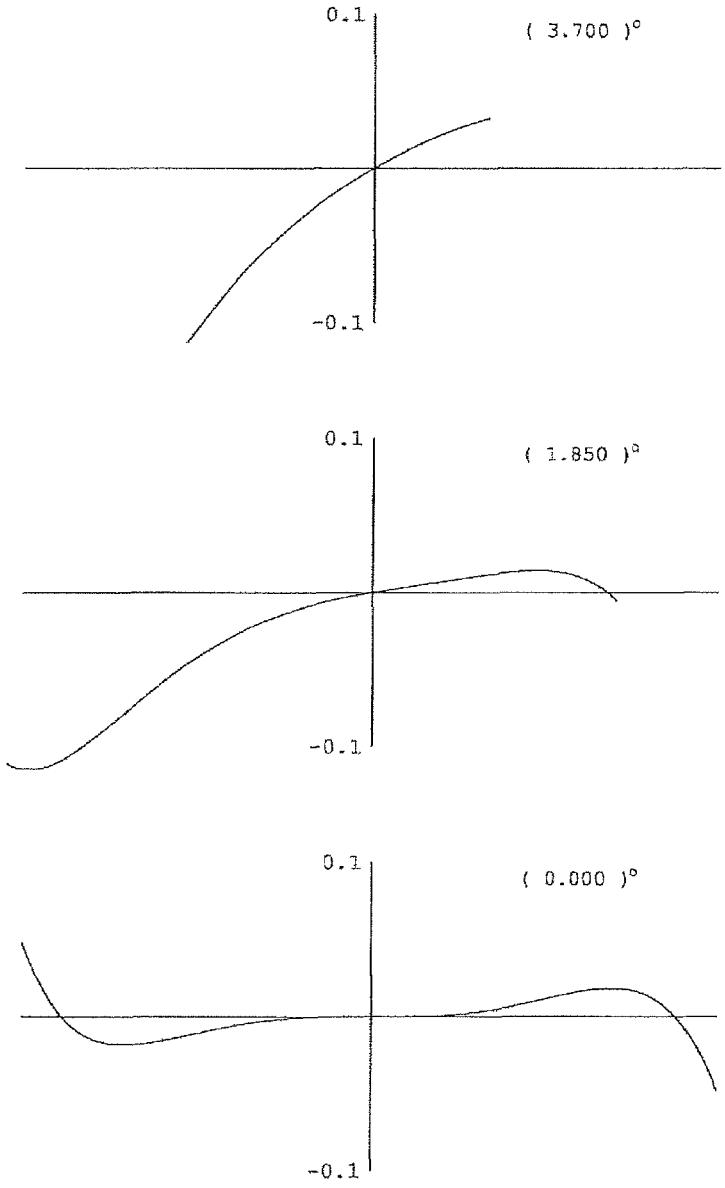

Fig. 4a2
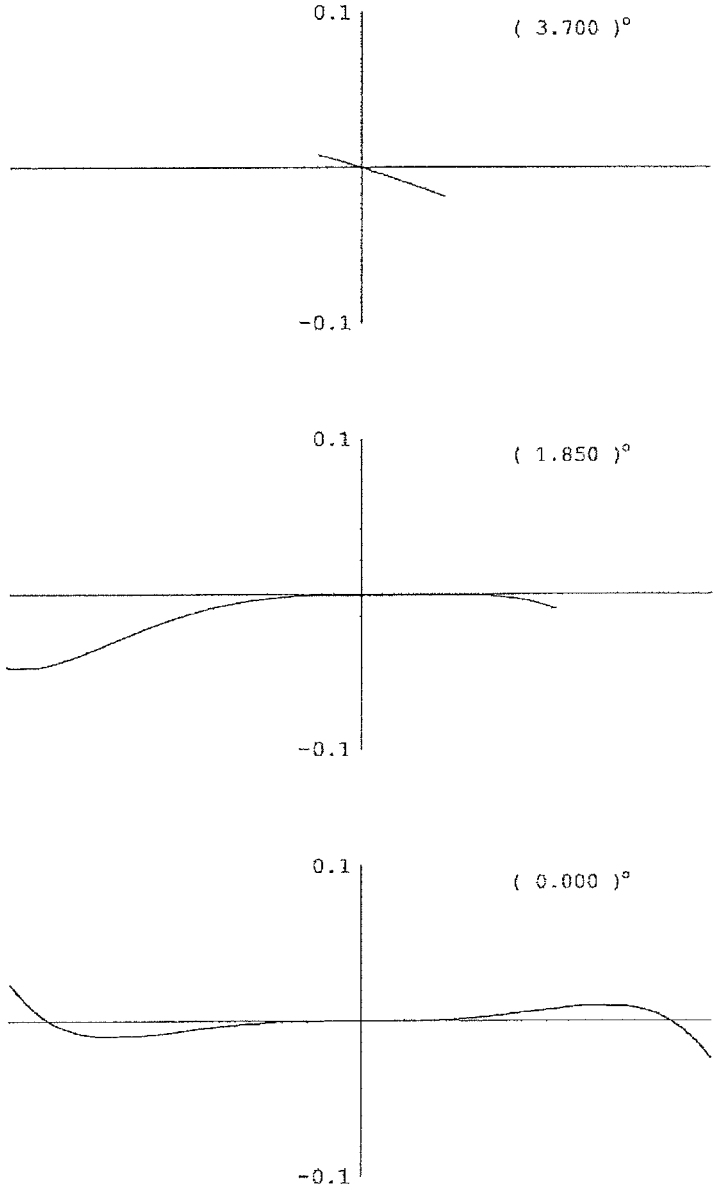

Fig.4b1
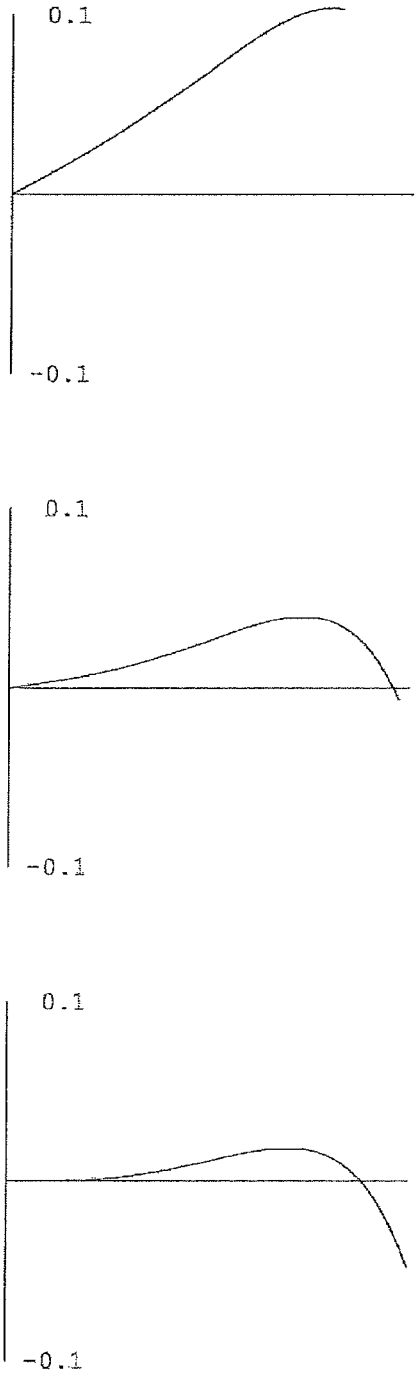

Fig.4b2
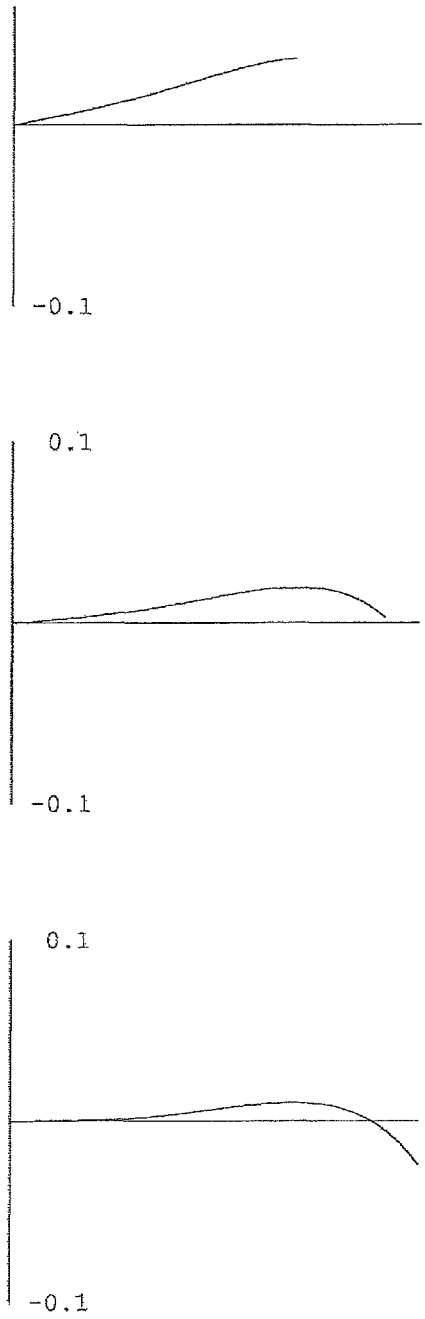

Fig.6a1
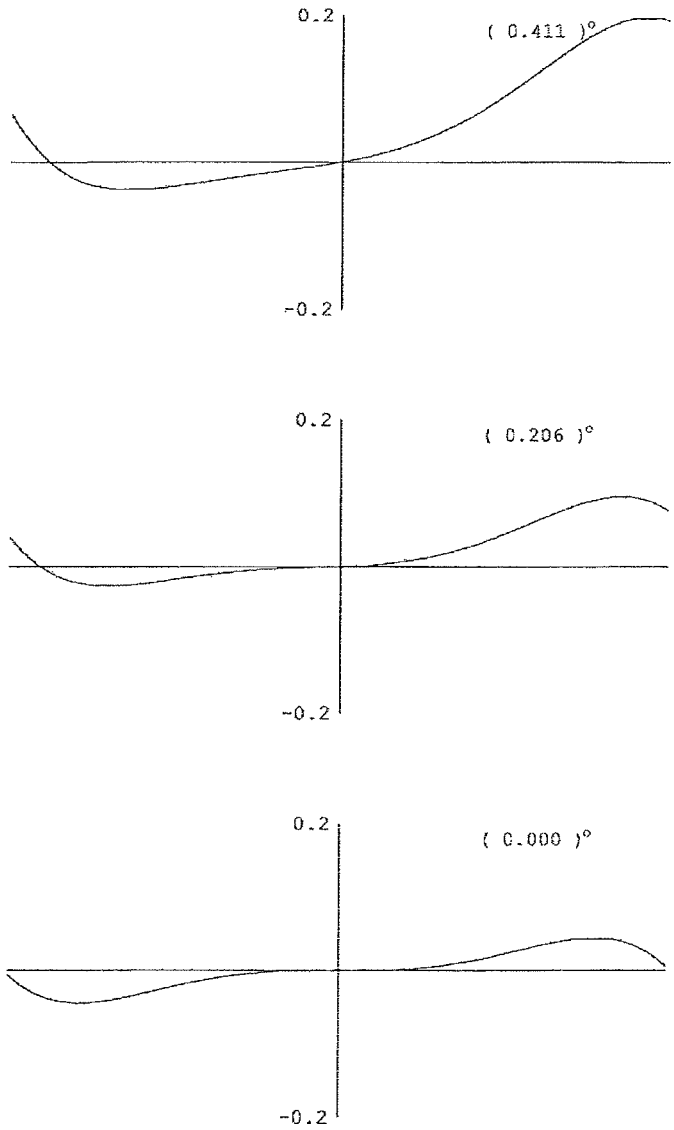

Fig.6a2
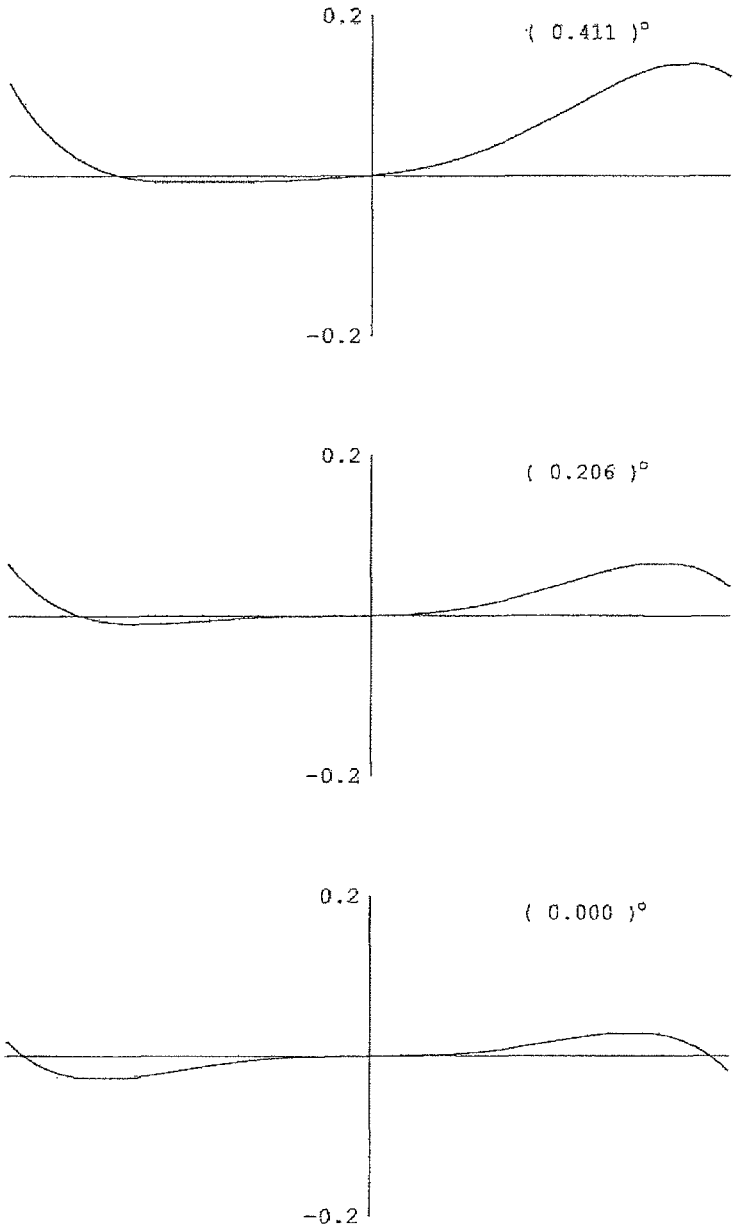

Fig.6b1
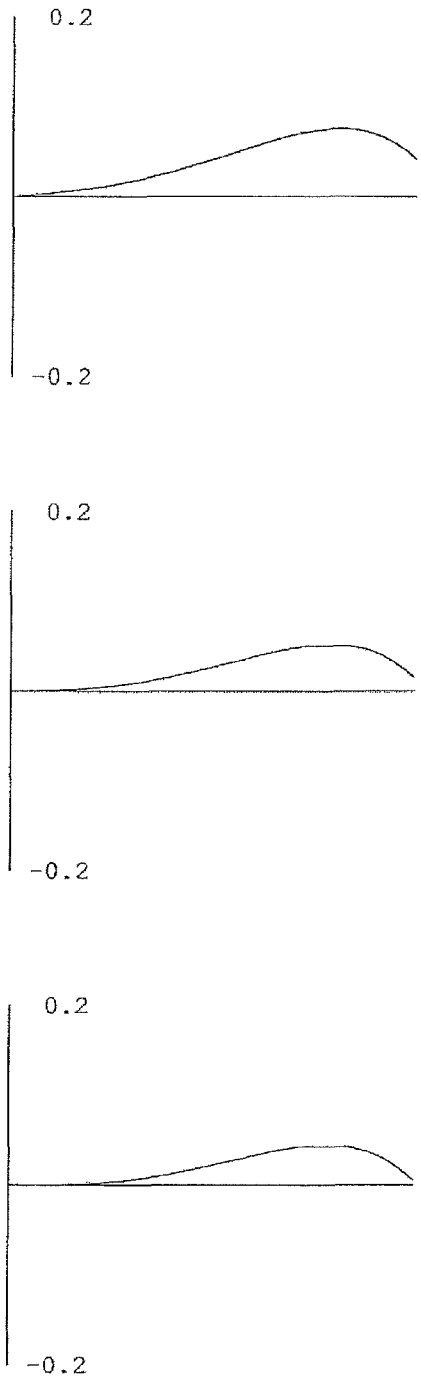

Fig.6b2
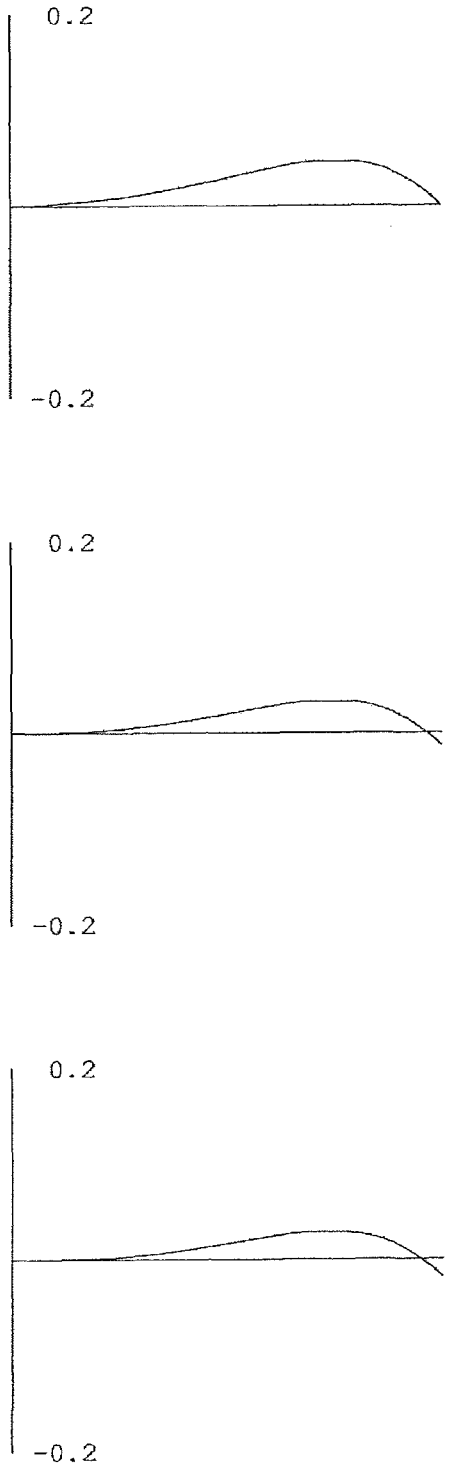

TARGET-FIELD TELESCOPE WITH CORRECTING LENS

FIELD OF THE INVENTION

The present invention relates to a sighting telescope.

BACKGROUND ART

Sighting telescopes are used in hunting and for military purposes to aim weapons at targets great distances away. For that purpose these telescopes are fitted with a configuration of lens elements inside a housing to magnify a target view. In particular said configuration includes an objective and an ocular. The objective is a converging optical system to achieve a real target image and the ocular is a system of lens elements allowing the eye to look into said configuration of lenses.

An intermediate image projected from the objective into an objective-proximate image plane is reproduced in an ocular-proximate image plane. However the accompanying magnification substantially restricts the field of view and it is difficult to sight or observe close-by objects. To allow also sighting such objects, the state of the art employs variable magnification, i.e. zooming means. Moreover, the sighted object is laterally inverted in the an objective-proximate image plane as well as being upside down, and therefore requires correction.

To correct and magnify the inverted image, a reversing system is used within the sighting telescope. This reversing system allows an axially independent, respectively a defined displacement of two optical elements. Such optical elements include single lenses, cemented lens elements and reticles. In this manner an intermediate image projected into an image plane situated between the objective and the reversing system is erected and it is reproduced magnified in the image plane situated between the reversing system and the ocular where it is observed Such lens element configurations however incur image defects. In the course of an object image reproduction into a virtual or real intermediate image, each lens element generates various aberrations, among which spherical aberration, defocusing, comas, field curvature, pincushion distortion, longitudinal and transverse color defects of different orders.

To correct such defects in the first image plane, the lens elements in the objective of a sighting telescope are combined and configured in a way that said defects shall be mutually compensating as much as possible over the path followed by the beam. Illustratively lens elements of flint glass and crown glass are cemented to each other to correct color defects.

Even when using optical means, a residue of image defects remains in the first image plane and these defects are very noticeable in high-zoom binoculars/sighting telescopes especially when magnification exceeds 4× in the high magnification ocular-proximate image plane. Transverse defects increase linearly with magnification and longitudinal defects increase in a square relationship.

The state of the art meets this problem by reducing these image defects by skillfully designing the lens element system to assure constant, good image quality across the full range of magnification.

High-zoom systems of the state of the art incur experience conflicts when correcting the magnified image defects at high magnifications and when correcting aid image defects at small magnifications over the entire field of view. When the system of lens elements is designed to compensate as well as possible the high-magnification image defects reproducing from the first image plane into the ocular-proximate image plane between the reversing system and the ocular, then clearly visible residual defects are incurred at low magnification, in particular coma and spherical aberration.

These image defects leave the user with the impression of low quality, especially as regards sparkle, steadiness and image sharpness.

Illustratively, a high-zoom sighting telescope is described in EP 1 746 451 B1. It describes a sighting telescope with a center tube configured between an objective and an ocular. The center tube receives a reversing system into which is integrated an adjustable magnifying optics. The magnifying optics consists of two mutually displaceable optical lens elements This reversing system is mounted between an objective-proximate image plane and an ocular-proximate image plane. By displacing the said lens elements, an intermediate image projected by the objective into the objective-proximate image plane is magnified in the an ocular-proximate image plane and in erected form. The maximum magnification is at least 4×.

Also, an optical beam deflecting unit is integrated into the reversing system. Said unit consists of an additional lens configuration situated on the reversing system's side facing the ocular and exhibiting a negative refraction between −20 dpt (diopters) and −40 dpt. This feature enhances the range of magnification. As a result, at all magnifications, a subjective sighting telescope field of view of at least 22° is assured at least for light of a wavelength of about 550 nm.

In addition the reversing system comprises a field lens spaced from the an objective-proximate image plane to allow a beam of rays from the objective and from an object point at the edge of the field of view being guided through the narrow duct of the reversing system.

The purpose of this field lens also is displacing the sighting telescope's range of magnification; this field lens is not primarily used for image defect correction.

Further and more developed sighting telescopes comprise a third, optical element in the reversing system (for instance U.S. Pat. No. 7,684,114 B2) in order to reduce image defects of high-zoom sighting telescopes, or they use aspheric lens elements in said reversing system. However a third displaceable optical element heightens the requirements of accurate guidance, entailing higher complexity as well as costs. Again the manufacture of aspheric lens elements is costly.

Accordingly the purpose of the present invention is to reduce the image defects across the full magnification range, in particular at the edges and also at lesser magnifications, the technical solution entailing little complexity and low costs. This sighting telescope shall be simple and easily handled and offer long service life.

SUMMARY OF THE INVENTION

As regards a sighting telescope comprising a reversing system which is configured between an objective and an ocular and is fitted with an objective-proximate field lens and at least two mutually ocular-proximate displaceable optical elements, said telescope further comprising an objective-proximate image plane situated between the field lens and the ocular from which it is spaced away toward the objective, further an ocular-proximate image plane situated between this the reversal system and the ocular, where, by displacing the optical elements, an intermediate image projected from the objective into the objective-proximate image plane is erected at variable magnification in the ocular-proximate image, and further at an at-least four-fold magnification, the present invention stipulates that a correcting field lens element be configured between the objective-proximate image plane and the field lens.

Such a correction lens element is fixed in place, and accordingly the sighting telescope's complexity increases only slightly. Beam correction taking place already before the beam reaches the field lens, image defects are transmitted attenuated in the reversing system. As a result, image quality increases considerably.

In especially advantageous manner, the correcting field lens element is situated the an objective-proximate image plane and the field lens, this feature allowing correcting the objective defects.

The table below shows effect of the correcting field lens element on image defects of the 3$^{rd}$ order according to an optics design program MIL-HDBK-141 (Military Standardization Handbook: Optical Design):

| | Image-defect intensity from the Optical Design Program of MIL-HDBK-141 | | | | | |
|---|---|---|---|---|---|---|
| | WITHOUT CORRECTING FIELD LENS ELEMENT | | | WITH CORRECTIING FIELD LENS ELEMENT | | |
| Kind of image defect | small magnification | mean magnification | large magnification | small magnification | mean magnification | large magnification |
| Aspheric aberration | 0.821086 | 0.150681 | 0.235905 | 0.448830 | 0.106225 | 0.187797 |
| Coma | −0.199421 | −0.100022 | 0.100028 | −0.051632 | −0.100011 | 0.100030 |
| Tangential astigmatism | 0.307891 | −0.011196 | 0.067351 | 0.066316 | −0.051988 | 0.033315 |
| Sagittal astigmatism | 0.239279 | 0.023984 | 0.037844 | 0.136409 | 0.004444 | 0.023182 |
| Field curvature | 0.204973 | 0.041574 | 0.023091 | 0.171455 | 0.032660 | 0.018116 |
| Distortion | −0.342277 | −0.267520 | −0.275009 | −0.071922 | −0.354690 | −0.373345 |
| Chromatic longitudinal defect | 0.085116 | 0.136314 | 0.225582 | 0.080157 | 0.127397 | 0.197048 |
| Chromatic transverse defect | −0.009277 | −0.018927 | −0.020088 | −0.009153 | −0.022958 | −0.027716 |

Being fixed in place, the correcting field lens element is insensitive to shocks and to thermal changes generated under different operational conditions. This means a long service life for the sighting telescope. Also the force required to adjust the displaceable optical elements is not increased where otherwise a sturdier and hence heavier design would be required. The few additional components needed by this invention only insignificantly raise the sighting telescope's weight. It remains lightweight, comfortable and easily handled.

The special advantages of the correcting field lens element in its position of the invention arise from correcting different image defects which now occur attenuated in the an ocular-proximate image plane. Said position is especially advantageous when it is between the objective-proximate image plane and the field lens. This field lens changes the image defect correction as a function of the positions of the displaceable optical elements and hence of the magnification. This feature makes it now feasible to design the image defect correction across the full zoom range in a manner that a brilliant, sharp and well illuminated image is reproduced on the an ocular-proximate image plane. A third, displaceable optical element in the reversing system is unnecessary.

The correcting field lens element affects the image beam in a manner that for instance aspheric aberration and coma are reduced at all magnifications, especially also at the lower ones, in the an ocular-proximate image plane, and furthermore astigmatism and image field curvature defects also are reduced.

The correcting field lens element not only corrects the aberrations transmitted from the objective but also compensates those arising in the reversing system, as a result of which an optimally good image is generated in the an ocular-proximate image plane.

The above tabulated values show that the correcting field lens element considerably reduces almost any kind of image defect.

In one embodiment mode of the present invention, the correcting field lens element is mounted at the side of the an objective-proximate image plane and facing away from this objective.

In especially advantageous manner, the lens element may be fitted with plane side facing the objective and it may be situated directly at the objective-proximate image plane. This feature allows cementing the lens element to a graticule or a reticle. As a result transmission is little degraded while the otherwise high susceptibility of the glass surfaces of the reticle and correcting field lens element to scratches in the cemented surface is clearly reduced.

Moreover the correcting field lens element may be converging or diverging. For that purpose it may be convex, concave or flat. A spherical and or plane surface is especially advantageous, such a correcting field lens element being substantially more economical than an aspheric lens element.

In a further embodiment mode, a reticle is mounted on the correcting field lens element, preferably in the objective-proximate image plane. The correcting field lens element and the reticle may be cemented together. Such a feature substantially reduces the complexity of the optical configuration and of the required fasteners. Vibrations and thermal effects do not additionally affect the said optical configuration. Also the sighting telescope's weight remains low and handling is comfortable. In principle, however, the reticle also may be situated in the ocular-proximate image plane, which is frequently the case in the US market.

Also a beam splitter may be configured between the ocular-proximate image plane and this ocular itself. This beam splitter may serve to reflect a further targeting mark into the target field glass.

In one embodiment variation of the invention, the objective consists of an objective lens element and of an objective achromat configured between this objective lens element and the an objective-proximate image plane. A further objective achromat may be provided which is situated on the same or opposite side of the objective lens element. Again the ocular may consist of an ocular lens element, further of an ocular achromat configured between said ocular lens element and the ocular-proximate image plane. Longitudinal and transverse chromatic defects may be substantially reduced using these achromats.

As an additional technical feature, the second optical element is configured closer to the ocular than is the first optical element and a beam deflecting unit having a negative index of refraction is situated in the reversing system between the second optical element and the an ocular-proximate image plane. As a result, the range of magnification is extended. This is especially advantageous for high-zoom sighting telescopes.

The correcting field lens element is especially advantageous in improving image quality when the maximum magnification of the intermediate image is at least 5×, preferably however at least 6× and especially preferably at least 8×. In this manner, even at low magnifications, a sharp and sparkling image is obtained across the full image, especially as far as the image edge, and this is especially the case for large magnification ranges.

BRIEF DESCRIPTION OF THE DRAWINGS

Further features, details and advantages of the invention are defined in the claims and discussed below in the description of illustrative embodiment modes related to the appended drawings.

FIG. 4*a*1 shows a transverse aberration in the tangential plane for an optical configuration in the absence of a correcting field lens element at low magnification, FIG. 4*a*2 shows a transverse aberration in the tangential plane for an optical configuration in the presence of a correcting field lens element at low magnification, FIG. 4*b*1 shows a transverse aberration in the sagittal plane for an optical configuration in the absence of a correcting field lens element at low magnification, FIG. 4*b*2 shows a transverse aberration in the sagittal plane for an optical configuration in the presence of a correcting field lens element at low magnification, FIG. 6*a*1 shows a transverse aberration in the tangential plane for an optical configuration in the absence of a correcting field lens element at large magnification FIG. 6*a*2 shows a transverse aberration in the tangential plane for an optical configuration in the presence of correcting field lens element at large magnification, FIG. 6*b*1 shows a transverse aberration in the sagittal plane for an optical configuration in the absence of a correcting field lens element at large magnification, and FIG. 6*b*2 shows a transverse aberration in the sagittal plane for an optical configuration in the presence of a correcting field lens element at large magnification.

DETAILED DESCRIPTION OF THE INVENTION

Figure 1:
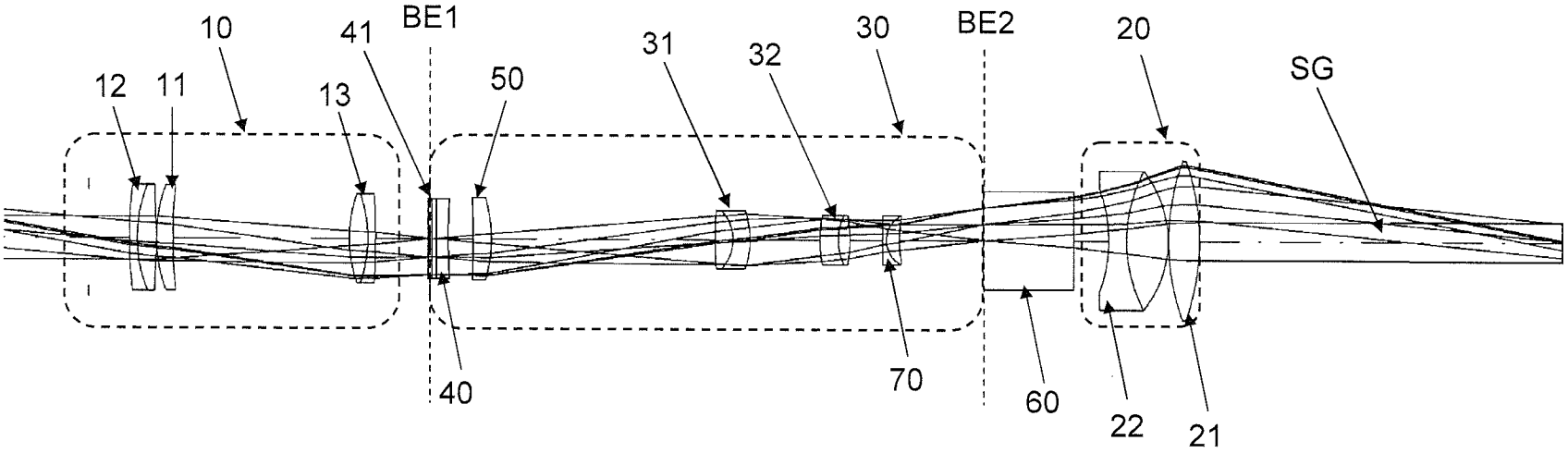
FIG. 1 is a cross-section of an optical configuration of the invention and its beam path.

FIG. 1 shows a cross-section of an optical configuration of the invention and with a beam path SG. A reversing system 30 is configured between an objective 10 and an ocular 20. The reversing system 30 comprises an objective-proximate field lens 50 and two mutually displaceable ocular-proximate optical elements 31, 31, the second optical element 32 being situated closer to the ocular 20 than the first optical element 31. An objective-proximate image plane BE1 is situated between the objective 10 and the field lens 50 and some distance from said field lens. An ocular-proximate image plane BE2 is situated between the ocular 20 and the reversing system 30.

The objective 10 comprises a first objective achromat 12, an objective lens element 11 configured between the objective achromat 12 and objective-proximate image plane BE1, and a second objective achromat 13 configured between the objective lens element 11 and the objective-proximate image plane BE1. The ocular 20 comprises an ocular lens element 21 and an ocular achromat 22 situated between the ocular lens element 21 and the ocular-proximate image plane BE2.

Additionally, there are a beam splitter 60 and a beam deflecting element 70. The beam splitter 60 is configured between the ocular-proximate image plane BE2 and the ocular 20 per se. The beam deflecting element 70 exhibits negative refractivity and is situated within the reversing system 30 between the second optical element 32 and the ocular-proximate image plane BE2.

The invention moreover includes a correcting field lens element 40 situated between the objective-proximate image plane BE1 and the field lens 50. This correcting field lens element 40 is cemented to a reticle 41 which is situated in the objective-proximate image plane BE1. Because of the physical size of the reticle 41, part of it is situated between the objective 10 and the objective-proximate image plane BE1 and part of it between said image plane BE1 and the field lens 50. The actual correcting field lens element 40 is away by that part of the reticle 41 running in the direction of the field lens 50 from the objective-proximate image plane BE1 by which the reticle 41 projects on sides of the field lens 50 beyond the objective-proximate image plane BE1.

By displacing the optical elements 31, 32, an intermediate image of variable magnification projected by the objective into the objective-proximate image plane BE1 is erected at variable magnification in the ocular-proximate image plane BE2.

As shown by the course of the beam SG, the field lens 50 concentrates this beam SG to a diameter of the first displaceable optical element 31.

Figure 2:
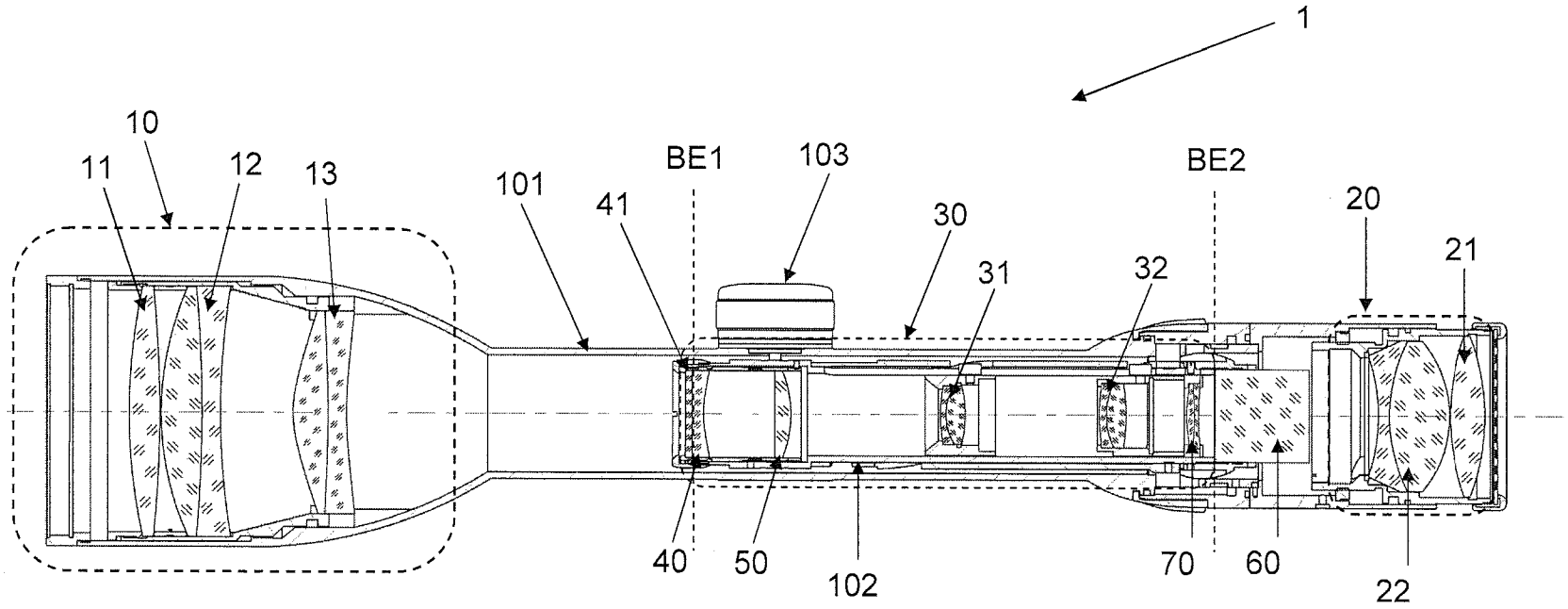
FIG. 2 is a cross-section of a sighting telescope of the invention.

FIG. 2 is a cross-section of a sighting telescope 1 integrating the features of the optical configuration of FIG. 1. A casing 101 receives a reversing system 30 inside a tube 102 and situated between an objective 10 and an ocular 20. The tube 102 is adjustably positioned within the casing 101 by means of an adjustment wheel 103. In this manner a reticle position can be adjusted to match optical target acquisition to the projectile's impact point. Absent such adjustability, impact position might deviate from target acquisition due to the projectile's flight path illustratively affected for instance by gravity and wind among others.

The reversing system 30 comprises a field lens 50 near the objective and two mutually displaceable ocular-proximate optical elements 31, 32, the second optical element 32 being closer to the ocular 20 than is the first optical element 31. An objective-proximate image plane BE1 is situated between the objective 10 and the field lens 50 but spaced from latter. Also, an ocular-proximate image plane BE2 is situated between the reversing system 30 and the ocular 20.

In further detail, the objective 10 comprises an objective lens 11 and two objective achromats 12, 13 configured between the objective element 11 the objective-proximate image plane BE1. The ocular 20 comprises an ocular lens 21 and ocular achromat 22 situated between the ocular lens element 21 and the ocular-proximate image plane BE2.

In the present invention, a correcting field lens element 40 is configured in the tube 102 between the objective-proximate image plane BE1 and the field lens 50. Said correcting field lens element is cemented to a reticle 41 positioned in the objective-proximate image plane BE1.

Additionally, the sighting telescope 1 is fitted with a beam splitter 60 and a beam deflecting element 70. The beam splitter 60 is affixed between the ocular-proximate image plane BE2 and the ocular 20 inside the casing 101. The beam deflecting element 70 evinces negative refraction and is situated in the reversing system 30 between the second optical element 32 and the ocular-proximate image plane BE2. Said beam deflecting element as well as the remainder of the reversing system 30 are configured inside the tube 102.

When displacing the optical elements 31, 32, an intermediate image projected by the objective 10 into the objective-proximate image plane BE1 will be erected at variable magnification in the ocular-proximate image plane BE2.

Figure 3A:
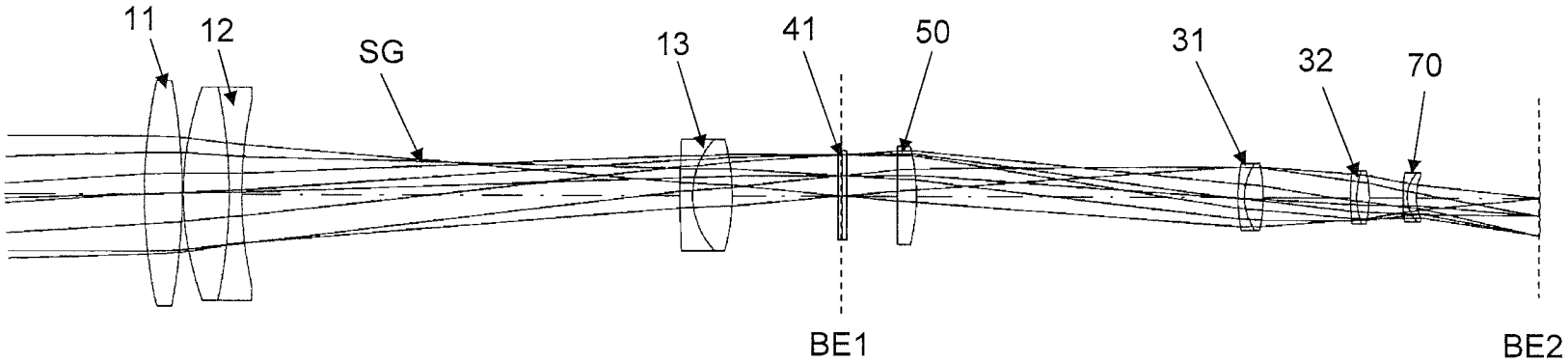
FIG. 3*a* shows a beam path of an optical configuration at low magnification and in the absence of a correcting field lens element.
Figure 3B:
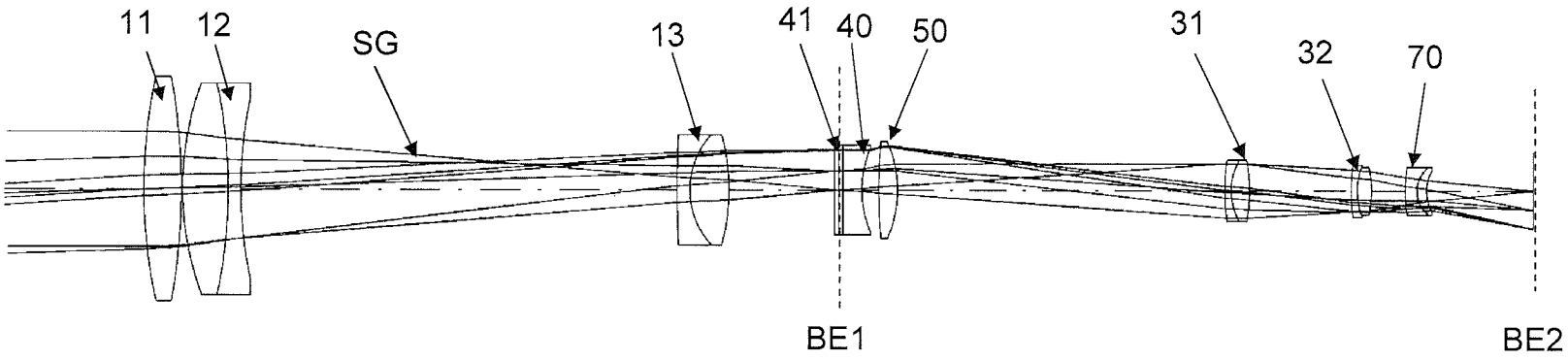
FIG. 3*b* shows a beam path of an optical configuration in the presence of a correcting field lens element at low magnification.

FIG. 3*a* and FIG. 3*b* each show an optical configuration. A reversing system is configured between an objective comprising an objective lens element 11 and two objective achromats 12, 13 and an ocular-proximate image plane BE2. This reversing system comprises a field lens 50 near the objective and, near the ocular, two mutually displaceable optical elements 31, 32, the second optical element 32 being closer to the ocular-proximate image plane BE2 than the first optical element 31. An objective-proximate image plane BE1 spaced from the field lens 50 is situated between the objective achromat 12 and said field lens. A reticle is 41 is configured in said image plane BE1.

The optical configuration of FIG. 3*b* differs from that of FIG. 3*a* by the presence of a correcting field lens element 40 between the objective-proximate image plane BE1 and the field lens 50. In particular the correcting field lens element 40 and the reticle 41 are cemented together.

The optical configurations of FIG. 3*a* and FIG. 3*b* each are crossed by a beam SG. Comparison of the two beams indicates that the correcting field lens element of FIG. 3*b* only little affects the path along the beam SG. On the whole, the rays run substantially the same ways. Nevertheless the correcting field lens element 41 strongly affects the image defects in the ocular-proximate image plane BE2 and in particular it reduces these defects.

The mutually displaceable optical elements 31, 32 are in a position of very low magnification. Such a condition can be inferred from the beams SG in that the spacing of the uppermost ray and of the lowermost ray of the beam SG of the object-proximate image plane BE1 approximately corresponds to that between the uppermost ray and the lowermost ray SG in the ocular-proximate image plane BE2.

FIG. 4*a*1, FIG. 4*a*2, FIG. 4*b*1 and FIG. 4*b*2 show plots of transverse aberrations at the ocular-proximate image plane at low magnification. The basic optical configurations correspond to those shown in FIG. 3*a* and FIG. 3*b*.

The plot of FIG. 4*a*1 shows the transverse aberration in the tangential plane in the absence of a correcting field lens element (see FIG. 3*a*) and the plot of FIG. 4*a*2 shows the transverse aberration in the tangential plane in the presence of the correcting field lens element (FIG. 3*b*). The abscissa of each graph shows the range of deviation from the ideal condition from −0.1 mm to +0.1 mm. The graph curve shows the transverse aberration in the tangential plane at the wavelength of 546 nm. The three graphs furthermore are arrayed in a manner that the distance of the measured point from the optical axis increases low to high. In particular the lowest graph always corresponds to the center of the field of view of an ocular-proximate image plane (FIELD HEIGHT=0.00) and the highest graph corresponds to the image field edge (FIELD HEIGHT=3.70).

Comparing the aberration plot of FIG. 4*a*1 to that of FIG. 4*a*2 shows that the tangential image surface is affected at every spacing from the image field center by the correcting field lens element. Especially the particular graphs in the aberration plot of FIG. 4*a*2 each are flatter and located more closely to the horizontal (which describes a defect-free ideal condition) than in the aberration diagram of FIG. 4*a*1. Accordingly the transverse aberration in the tangential plane of the aberration plot of FIG. 4*a*2—that is, in the presence of the correcting field lens element—is substantially less than for the aberration plot of FIG. 4*a*1.

The plot of FIG. 4*b*1 shows the transverse aberration in the sagittal plane in the absence of a correcting field lens element (see FIG. 3*a*) and the aberration plot of FIG. 4*b*2 shows the transverse aberration in the presence of the correcting field lens element (See FIG. 3*b*). The abscissa of each graph shows a deviation range from the ideal condition from −0.1 mm to +0.1 mm. The graph curve shows the transverse aberration in the sagittal plane for the wavelength of 546 nm. The three graphs furthermore are arrayed in a manner that the test point distance from the optic axis increase from below to above. In particular the lowest graph each time corresponds to the image center of the ocular-proximate image plane (FIELD HEIGHT=0.00) and the top graph corresponds to the image field edge (FIELD HEIGHT=3.70).

Comparison of the aberration plot of FIG. 4*b*1 with that of FIG. 4*b*2 shows that the correcting field lens element controls the sagittal image surface at every spacing to the image field center. In particular the individual graphs in the aberration plot of FIG. 4*b*2 always are flatter and closer to the horizontal describing the ideal state than they are in the aberration plot of FIG. 4*b*1. Accordingly the transverse aberration in the sagittal plane of the aberration lot of FIG. 4*b*2—that is, in the presence of the correcting field lens element—is substantially less than in the aberration plot of FIG. 4*b*1.

Figure 5A:
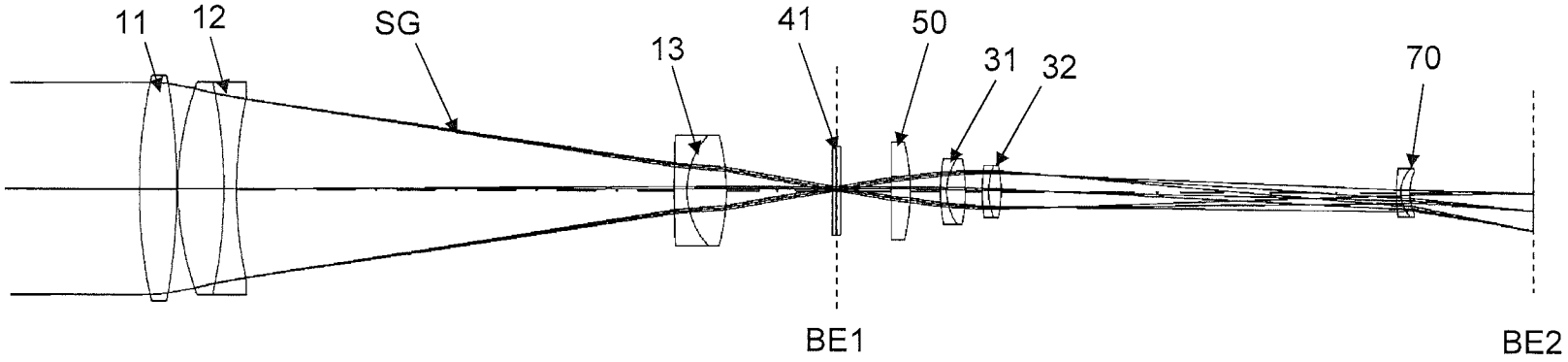
FIG. 5*a* shows a beam path of an optical configuration in the absence of a correcting field lens element at large magnification.
Figure 5B:
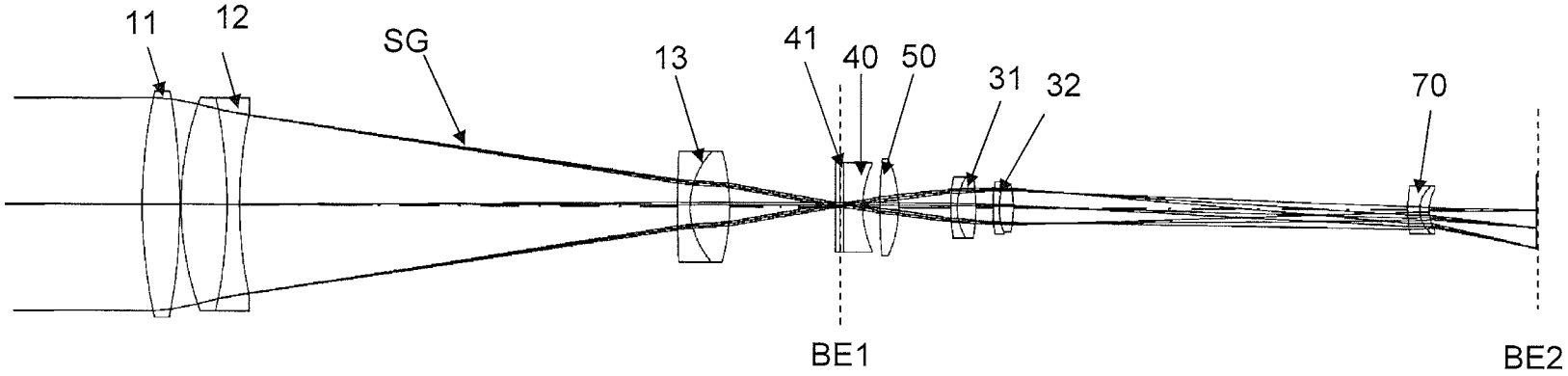
FIG. 5*b* shows a beam path of an optical configuration in the presence of a correcting field lens element at large magnification.

FIGS. 5*a* and 5*b* each illustrate an optical configuration. A reversing system is configured between an objective consisting of an objective lens element 11 and two objective achromats 12, 13 on one hand and on the other an ocular-proximate image plane BE2. The reversing system comprises a field lens 50 near the objective and, near the ocular, two mutually displaceable optical elements 31, 32, the second optical element 32 being closer to the ocular-proximate image plane BE2 than the first optical element 31. An objective-proximate image plane BE1 and spaced from the field lens 50 is situated between the objective achromat 12 and said field lens 50.

The configuration of FIG. 5*b* differs from that of FIG. 5*a* it that it comprises a corrective field lens element 40 situated between the objective-proximate image plane BE1 and the field lens 50. In particular said correcting field lens element 40 is cemented to the reticle 41.

A beam SG runs through each of these optical configurations of FIG. 5*a* and FIG. 5*b*. When comparing the particular rays/beams SG, one notices that the correcting field lens element 41 of FIG. 5*b* only little affects the ray/beam SG. The ray/beam SG is substantially the same over its course, Nevertheless the correcting field lens element 41 considerably controls the image defects in the objective-proximate image plane BE2, in particular it reduces them.

The displaceable optical elements 31, 32 are in a position where a large magnification is in effect. This feature can be seen from the rays SG, namely that the spacing of the uppermost ray and of the lowermost ray of the beam SG in the ocular-proximate image plane BE2 is substantially larger than that between the uppermost ray and lowermost ray of the beam SG in the objective-proximate image plane BE1.

FIG. 6*a*1, FIG. 6*a*2, FIG. 6*b*1 and FIG. 6*b*2 are aberration plots of transverse aberrations at the an ocular-proximate image plane at large magnification with and without a correcting field lens element. The optical configurations involved correspond those shown for FIG. 5*a* and FIG. 5*b*.

The aberration diagram plot of FIG. 6*a*1 shows the transverse aberration in the tangential plane in the absence of a correcting field lens element (Cf. FIG. 5*a*) and the aberration plot of FIG. 6*a*2 shows the transverse aberration in the tangential plane in the presence of a correcting field lens element (Cf. FIG. 5*b*). The abscissa of each graph shows a deviation range from the ideal state from −0.2 mm to +0.2 mm. The graph curve shows the transverse aberration in the tangential plane for the 546 nm wavelength. Also, three graphs are shown in a manner that the spacing of a test point from the optic axis increases from below to above. In particular the lowermost graph always corresponds to the image field center of the ocular-proximate image plane (FIELD HEIGHT=0.00) and the uppermost graph corresponds to image field edge (FIELD HEIGHT=0.411).

As shown by comparing the aberration plot of FIG. 6*a*1 to the aberration plot of FIG. 6*a*2, the tangential image surface is affected by each spacing to the image field center by the correcting field lens element. In particular the individual graphs in the aberration plot of FIG. 6*a*2 are configured always flatter and closer to the horizontal denoting a defect-free idealized state than in the aberration plot of FIG. 6*a*1. Accordingly the transverse aberration in the tangential plan of the aberration plot of FIG. 6*a*2—with a correcting field lens element—is substantially smaller than for the case of the aberration plot of FIG. 6*a*1. However the improvements are not as striking as they are for a lesser magnification shown in FIG. 4*a*1 and FIG. 4*a*2 because the optical configuration already is optimized for medium to high magnifications so that the correction due to the correcting field lens element is commensurately less at those magnifications.

The plot of FIG. 6*b*1 shows the transverse aberration in the sagittal plane in the absence of a correcting field lens element (Cf. FIG. 5*a*) and the aberration plot of FIG. 5*b*2 shows the transverse aberration in the sagittal plane in the presence of a correcting field lens element (Cf. FIG. 5*b*). The abscissa of each graph shows a deviation range from the ideal state of −0.2 mm to +0.2 mm. The graph line shows the transverse aberration in the sagittal plane for the 546 nm wavelength. Further, the three plots are configured in a way that the spacing of the test point from the optic axis increases from below to above. In particular the lowermost plot always corresponds to the image field center of the an ocular-proximate image plane (FIELD HEIGHT=0.00) and the uppermost graph corresponds to the image field edge (FIELD HEIGHT=0.411).

As indicated by comparing the aberration plot of FIG. 6*b*1 with the aberration plot of FIG. 6*b*2, the sagittal image surface is affected at every spacing to the image field center by the correcting field lens element. In particular the individual graphs in the aberration plot of FIG. 6*b*2 each are flatter and situated closer to the horizontal—which denotes a defect-free ideal state—than in the aberration plot of FIG. 6*b*1. Commensurately the transverse aberration in the sagittal plane of the aberration plot of FIG. 6*b*2, that is, in the presence of a correcting field lens element, is considerably less than in the aberration plot of FIG. 6*b*1. However the improvements are less striking than at a lesser magnification according to FIG. 4*b*1 and FIG. 4*b*2 because the optical configuration already was optimized for middle to high magnifications, thus the correction by the correcting field lens element being less at said magnifications.

The present invention is not restricted to the above described embodiment modes, on the contrary it may be modified in versatile manner.

All features and advantages implicit and explicit in the claims, the description and the drawing, inclusive design details, spatial arrays and procedural steps, may be construed being inventive, both per se as well as in arbitrary combinations.

LIST OF REFERENCES.

| | |
|---|---|
| 1 | sighting telescope |
| 10 | objective |
| 11 | objective lens element |
| 12 | first objective achromat |
| 13 | second objective achromat |
| 20 | ocular |
| 21 | ocular lens element |
| 22 | ocular achromat |
| 30 | reversing system |
| 31 | first optical element |
| 32 | second optical element |
| 40 | correcting field lens element |
| 41 | reticle |
| 50 | field lens |
| 60 | beam splitter |
| 70 | ray/beam deflecting element |
| 101 | casing |
| 102 | tube |
| 103 | adjusting wheel |
| BE1 | objective-proximate image plane |
| BE2 | ocular-proximate image plane |
| SG | course of ray/beam |

The invention claimed is:

1. A sighting telescope comprising a reversing system configured between an objective and an ocular, said reversing system being fitted with an objective-proximate field lens and with at least two mutually displaceable ocular-proximate optical elements, further comprising an objective-proximate image plane and situated between the objective and the field lens while being spaced from latter, and an ocular-proximate image plane situated between the ocular and the reversing system, where, by displacing the optical elements, an intermediate image projected by the objective into the objective-proximate image plane is erected at variable magnification in the image ocular-proximate plane, and designed with a minimally 4× magnification, characterized in that an additional correcting field lens element is configured stationary between the objective-proximate image plane and the field lens.

2. The sighting telescope as claimed in claim 1, characterized in that the additional correcting field lens element is situated at that side of the objective-proximate image plane which points away from the objective.

3. The sighting telescope as claimed in claim 1, characterized in that the additional correcting field lens element is concentrating or diverging.

4. The sighting telescope as claimed in claim 1, characterized in that a reticle is mounted to the additional correcting field lens element.

5. The sighting telescope as claimed in claim 4, characterized in that the additional correcting field lens element and the reticle are cemented to each other.

6. The sighting telescope as claimed in claim 1, characterized in that a beam splitter is configured between the ocular-proximate image plane and the ocular itself.

7. The sighting telescope as claimed in claim 1, characterized in that the objective consists of an objective lens element and an objective achromat which is configured between said objective lens element and the objective-proximate image plane.

8. The sighting telescope as claimed in claim 1, characterized in that the ocular consists of an ocular lens element and an ocular achromat configured between said ocular lens element and the ocular-proximate image plane.

9. The sighting telescope as claimed in claim 1, characterized in that the second optical element is configured closer to the ocular than the first optical element and in that a beam deflecting element of negative refractivity is mounted between the second optical element and the ocular-proximate image plane.

10. The sighting telescope as claimed in claim 1, characterized in that the maximum intermediate image magnification at the ocular-proximate image plane is at least 5×.

11. The sighting telescope as claimed in claim 4, wherein the reticle is mounted to the additional field lens element and in the objective-proximate image plane.

12. The sighting telescope as claimed in claim 10, wherein the maximum intermediate image magnification is at least 6×.

13. The sighting telescope as claimed in claim 10, wherein the maximum intermediate image magnification is at least 8×.

* * * * *